US005467765A

United States Patent [19]

Maturaporn

[11] Patent Number: 5,467,765

[45] Date of Patent: Nov. 21, 1995

[54] DISPOSABLE FACE MASK WITH MULTIPLE LIQUID RESISTANT LAYERS

[76] Inventor: Thawatchai Maturaporn, 127 Ratchadapisek Road, Chongnonsee, Bangkok 10120, THX

[21] Appl. No.: 319,006

[22] Filed: Oct. 6, 1994

[51] Int. Cl.[6] ..... A62B 7/10; A62B 18/02; A62B 23/02; A62B 18/08

[52] U.S. Cl. ..... 128/206.19; 128/206.13; 128/206.12

[58] Field of Search ..... 128/206.19, 201.17, 128/206.12, 206.13

[56] References Cited

U.S. PATENT DOCUMENTS

| | | | |
|---|---|---|---|
| Re. 28,102 | 8/1974 | Mayhew . | |
| 3,170,461 | 2/1965 | Watts, Jr. . | |
| 3,603,315 | 9/1971 | Becker, III . | |
| 3,613,678 | 10/1971 | Mayhew . | |
| 4,419,993 | 12/1983 | Petersen | 128/206.19 |
| 4,454,881 | 6/1984 | Huber et al. | 128/206.19 |
| 4,508,113 | 4/1985 | Malaney . | |
| 4,522,203 | 6/1985 | Mays . | |
| 4,589,408 | 5/1986 | Singer | 128/206.19 |
| 4,600,002 | 7/1986 | Maryyanek et al. | 128/206.19 |
| 4,662,005 | 5/1987 | Grier-Idris . | |
| 4,684,570 | 8/1987 | Malaney . | |
| 4,688,566 | 8/1987 | Boyce | 128/206.19 |
| 4,807,619 | 2/1989 | Dyrud et al. | 128/206.19 |
| 4,827,924 | 5/1989 | Japuntich | 128/206.19 |
| 4,850,347 | 7/1989 | Skov | 128/206.19 |
| 4,883,052 | 11/1989 | Weiss et al. | 128/206.19 |
| 4,920,960 | 5/1990 | Hubbard et al. . | |
| 4,941,470 | 7/1990 | Hubbard et al. | 128/206.19 |
| 4,969,457 | 11/1990 | Hubbard et al. . | |
| 5,322,061 | 6/1994 | Brunson | 128/206.13 |
| 5,374,458 | 12/1994 | Burgio | 128/206.19 |

*Primary Examiner*—Kimberly L. Asher
*Attorney, Agent, or Firm*—Ezra Sutton

[57] ABSTRACT

A pleated, disposable, liquid-resistant face mask formed of a three-ply or four-ply composite laminate structure that is conformable to the shape of the wearer's face. The three-ply face mask has a first ply formed of a non-woven material, a carded cotton material, and a creped tissue wadding material; a second ply formed of a non-woven, meltblown, polypropylene material; and a third ply formed of a non-woven, thermobond, polypropylene material. In the four-ply mask,there is an additional ply of non-woven, colored, spunbond, polypropylene material which may be of any color and acts as the face-contacting surface of the face mask.

39 Claims, 10 Drawing Sheets

10

DISPOSABLE FACE MASK WITH MULTIPLE LIQUID RESISTANT LAYERS

FIELD OF THE INVENTION

The present invention relates to disposable, pleated face masks and their method of manufacture and, more particularly, to disposable, pleated face masks that are liquid (waterproof) resistant. The face mask has a safety advantage and has applications in the health care, medical, mining, industrial, farming, and environmental workplaces.

BACKGROUND OF THE INVENTION

Disposable face masks have been in use for the past fifty years and have a wide variety of applications in today's workplace. The disposable face mask provides protection for the wearer against bodily infection of bacteria and some viruses by patients in surgery or in other hospital, health care, or nursing home settings. Also, it provides to the wearer protection against upper respiratory ailments of the lungs, throat, nose, and mouth by protecting against harmful particulate matter.

Such particulate matter can be mineral, liquid, vapor, dust, or fibrous dust from mining or lumber manufacturing operations; or in chemical/pharmaceutical manufacturing operations which produce organic/inorganic dusts and/or liquid vapors; and/or in environmental contamination clean-ups of oil spills, asbestos dust, and from contaminated water wells, lakes, etc.

The disposable face mask has been somewhat standardized in that most masks today have multiple layers or plies of different non-woven fabric materials that form a composite material laminate that is used for the nose and mouth section of the mask. Examples of the different types of non-woven fabric layers typically used in the face mask composite laminate are as follows: cellulose; fiberglass, cloth, polyurethane, polyethylene, vinyl acetate, polypropylene, polyesters, polyamides, etc. Different combinations of the aforementioned materials have been used to form layers or plies that are made into a composite material laminate for the body of the face mask. A typical laminate used in a disposable face mask has been a cellulosic first layer, a polyethylene middle layer, and a chemically-coated polyethylene outer layer which forms a three-ply or layered laminate for the body of a face mask. This type of three-ply face mask typically is produced and used in the present marketplace.

Currently available disposable face masks do not prevent the passage of liquids that are external to the mask of the wearer. Thus, there is a need for a liquid-resistant, disposable face mask that will allow the passage of air but prevents the passing of liquids through the mask by trapping the liquid in the mask in order to protect the wearer.

DESCRIPTION OF THE PRIOR ART

Disposable surgical face masks of different designs and laminate construction have been disclosed in the prior art. For example, U.S. Pat. No. 3,170,461 to Watts, Jr. discloses a face mask having pleats and a multiple-ply laminate body. The multiple-ply laminate body includes an inner layer (first ply) made of cellulose fibers reinforced with cloth threads; a central core of layers (second ply thorough sixth ply) made of a plurality of non-woven absorbent cellulose materials; and an outer surface layer (seventh ply) formed of a non-porous sheet of an impervious material preferably, polyethylene film.

U.S. Pat. No. 3,603,315 to Becker discloses a face mask having a pleated central portion and tie strips for securing the mask to the face of the wearer. The face mask comprises a threeply panel having an inner layer (first ply worn against the face) formed of an open pore polymeric foam material, such as polyurethane; an intermediate layer (second ply) formed of a standard filter medium material, such as matted fiberglass; and the outer layer (third ply) is formed of a non-woven cloth or soft porous paper.

U.S. Pat. No. 3,613,678 to Mayhew and U.S. No. Re. 28,102 disclose a face mask having pleats. The face mask has a body portion comprising a face-contacting surface layer (first ply) made of a thin, soft, flexible, self-sustaining, non-absorbent, highly-porous discontinuous film of fused and coalesced non-woven, inert, thermoplastic, synthetic polymeric fibers; the central filtering layer (second ply) is made of a web of tiny thermoplastic organic fibers, such as polypropylene, polyethylene, polyesters, polyamides, etc.; and the outer layer (third ply) is made from any porous fabric, woven or non-woven.

U.S. Pat. No. 4,662,005 to Grier-Idris discloses the use of a pouch-like, conformable surgical face mask. The face mask has a laminate porous pad consisting of three plies of materials, such that the outer layer (first ply) is made of a non-woven spun-bonded material; an intermediate layer (second ply) is made of a non-woven melt-blown material; and the inner layer (third ply) is made of a non-woven cover stock formed from a cellulosic material or cellulosic material in combination with synthetic fibers.

The aforementioned patents do not teach the use of a multiple-ply laminate that is liquid resistant to the wearer.

U.S. Pat. Nos. 4,684,570 and 4,508,113 to Malaney and U.S. Pat. No. 4,522,203 to Mays (aforementioned patents all assigned to Chicopee Division of Johnson & Johnson Corporation of New Brunswick, N.J.) disclose the use of a multiple-ply laminate structure that is water impervious and is used for surgical drapes, face masks, and tray covers, and also as a backing layer for baby diapers or sanitary napkins. These patents also do not teach the use of a liquid-resistant, multiple-ply laminate.

U.S. Pat. Nos. 4,969,457 and 4,920,960 to Hubbard et al discloses a face mask having a plurality of pleats for expansion over the nose and mouth of the wearer. The mask is removably attached to the wearer by elastic loops or tie strips, and it has a stiffening member. The face mask has a three-ply or a four-ply laminate structure that is substantially impervious to the passage of body fluids, which comprises an internal layer (first ply being the bottom layer) made of a non-woven, non-wicking fabric material; a barrier layer (second ply) made of a low-density polyethylene (LDPE); a filtration media layer (third ply) made of a melt-blown polypropylene or polyester; and a cover stock layer (fourth ply being the outermost layer) made of a non-woven cellulose fiber that had been chemically treated by a fluorocarbon. These patents do not teach the use of a laminate structure comprising non-woven airlaid fabric and non-woven polypropylene fabric that is liquid resistant.

Accordingly, it is an object of the present invention to provide a disposable pleated face mask that is liquid resistant.

Another object of the present invention is to provide a disposable pleated face mask that has a three-ply laminate composite structure, wherein all of the plies are a non-woven, liquid-resistant, non-absorbent fabric material.

Another object of the present invention is to provide a disposable pleated face mask that has a four-ply laminate composite structure, wherein all of the plies are of a non-woven, liquid-resistant, non-absorbent fabric material.

Another object of the present invention is to provide a disposable pleated face mask that prevents the passage of liquids through the face mask by trapping any liquids within the interstices of the laminate composite structure while still allowing air to pass through the mask to the wearer.

It is still another object of the present invention to provide a disposable pleated face mask, wherein the laminate plies are formed of a non-woven, airlaid paper material and non-woven polypropylene materials, A still further object of the present invention is to provide an economical and efficient method of manufacturing a liquid-resistant, disposable face mask.

SUMMARY OF THE INVENTION

The present invention discloses a disposable face mask and a method of manufacturing a disposable face mask that is liquid resistant. In the present invention, the liquid-resistant face mask is defined as one that will not pass any bodily liquids, such as blood, saliva, and perspiration, during use. However, if the mask becomes saturated with such liquids, it is recommended that the mask be changed, since it is possible that upon saturation, liquids may pass through one or more of the plies of the mask.

Thus, the face mask of the present invention will prevent the passage of both body liquids or manufacturing/environmental liquid contaminates to the wearer of the face mask. The present invention allows the wearer to breath freely, as the mask is pervious to air, while preventing the penetration of liquids to the wearer's mouth and nose by trapping the liquids within the interstices of the non-woven materials used to make the face mask.

In the preferred or first embodiment, the liquid-resistant disposable face mask has a three-layered laminate structure that is pleated and sized to cover the wearer's nose and mouth. The innermost layer (the first ply) which comes in contact with the wearer's face is made of non-woven, airlaid paper material that is liquid resistant and is designed to be soft to the wearer's face and prevent facial hair, perspiration, and saliva from exiting the face mask. The second layer is the middle section of the face mask and is made of non-woven, liquid-resistant, meltblown, polypropylene material which is designed to act as a filter media barrier against bacteria, body fluids, and particulate contaminants. The outermost layer (the third ply) of the face mask is made of non-woven, liquid-resistant, thermobond, polypropylene material which is designed to be the first contact filter barrier layer against body fluids and liquid particulate contaminants from outside of the wearer's face mask.

The face mask's three-ply laminate structure is made into a single entity by the use of an ultrasonic heat-sealing machine, which heat seals the perimeter edges of the three-ply laminate composite structure. The face mask is secured to the wearer's head and face by either ear loops or head ties.

In an alternate or second embodiment, the liquid-resistant, disposable face mask has a four-layered laminate structure that is sized and pleated to cover the wearer's nose and mouth. The innermost layer (the first ply) which comes in contact with the wearer's face is made of non-woven, colored spunbond, polypropylene material that is designed to be soft to the wearer's face and act as an initial barrier to liquid and particulate matter for the wearer of the mask. The second layer is made of a non-woven, liquid-resistant, airlaid paper material and is designed to act as a liquid barrier. The third layer is made of a non-woven, liquid-resistant, meltblown, polypropylene material which is designed to act as a filter media barrier against bacteria, body fluids, and particulate contaminants. The outermost layer (the fourth ply) of the fact mask is made of non-woven, liquid-resistant, thermobond, polypropylene material which is designed to be the first contact filter barrier layer against body fluids and liquid particulate contaminants from outside of the wearer's face mask.

The face mask's four-ply laminate structure is made into a single entity by the use of an ultrasonic heat-sealing machine, which heat seals the perimeter edges of the four-ply laminate composite structure. The four-ply face mask is secured to the wearer's head and face by either ear loops or head ties.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENT 10

Figure 1:
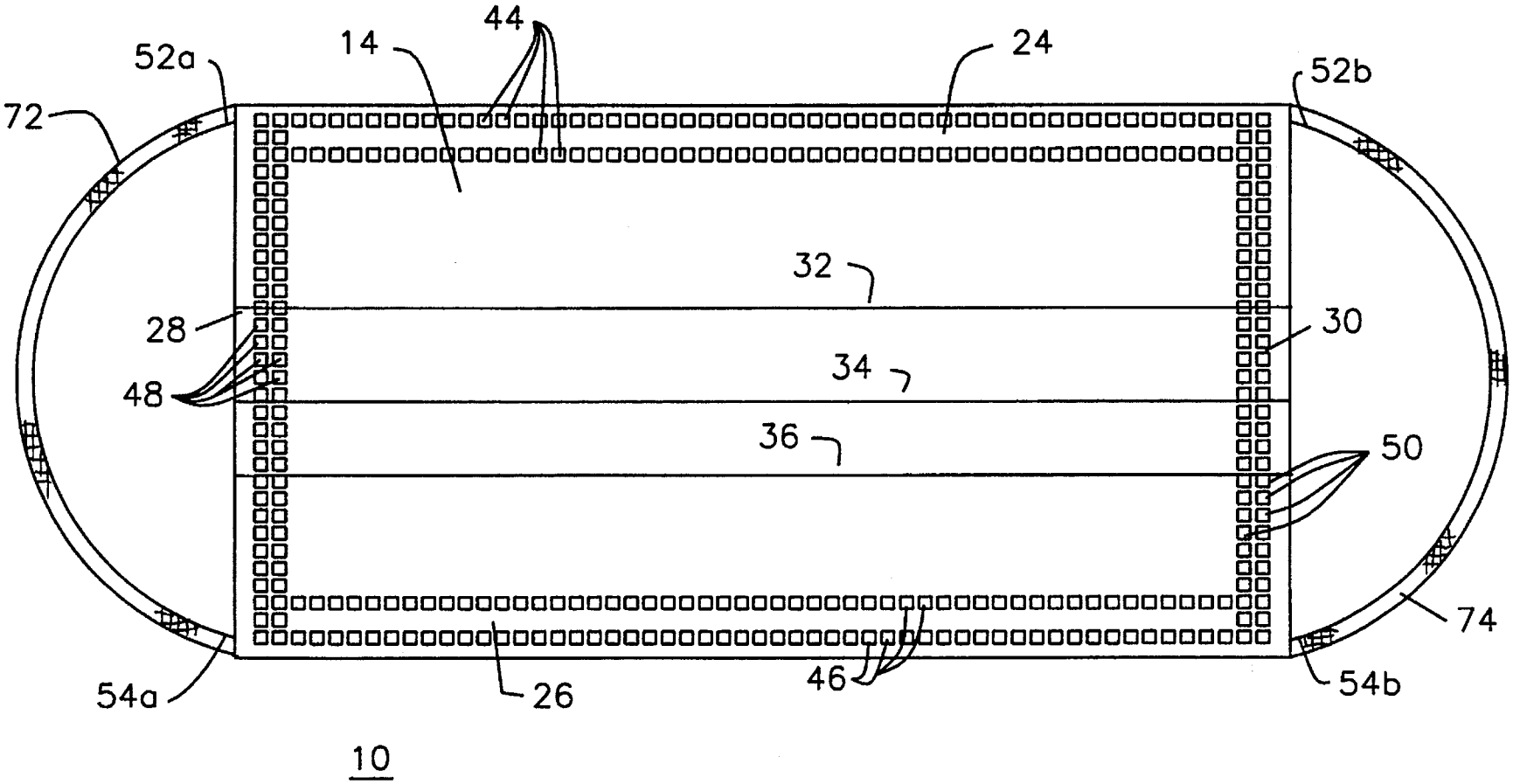
FIG. 1 is a rear view of the first embodiment of the present invention showing the pleated face mask with ear loops.
Figure 2:
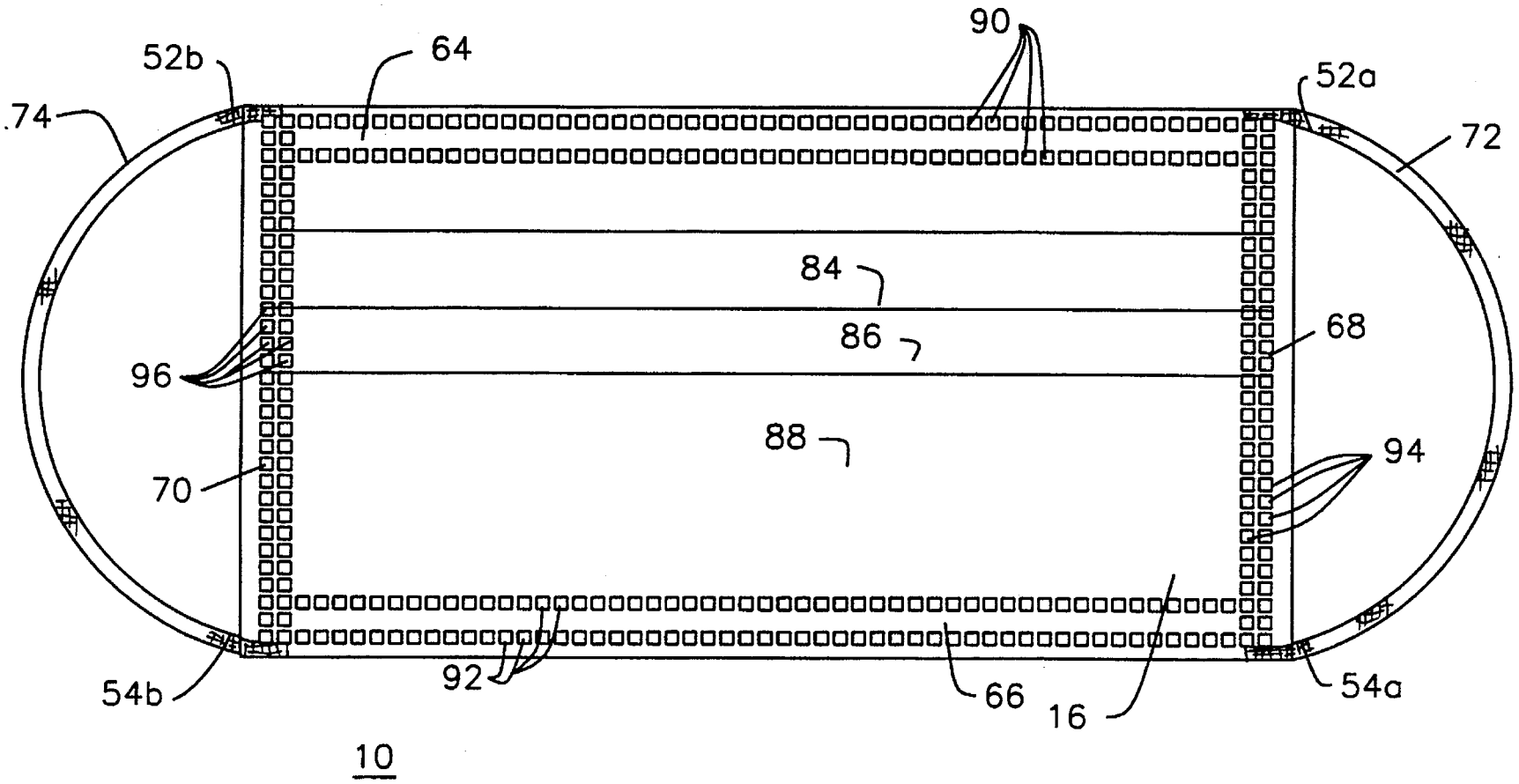
FIG. 2 is a front view of the first embodiment of the present invention showing the pleated face mask with ear loops.
Figure 3:
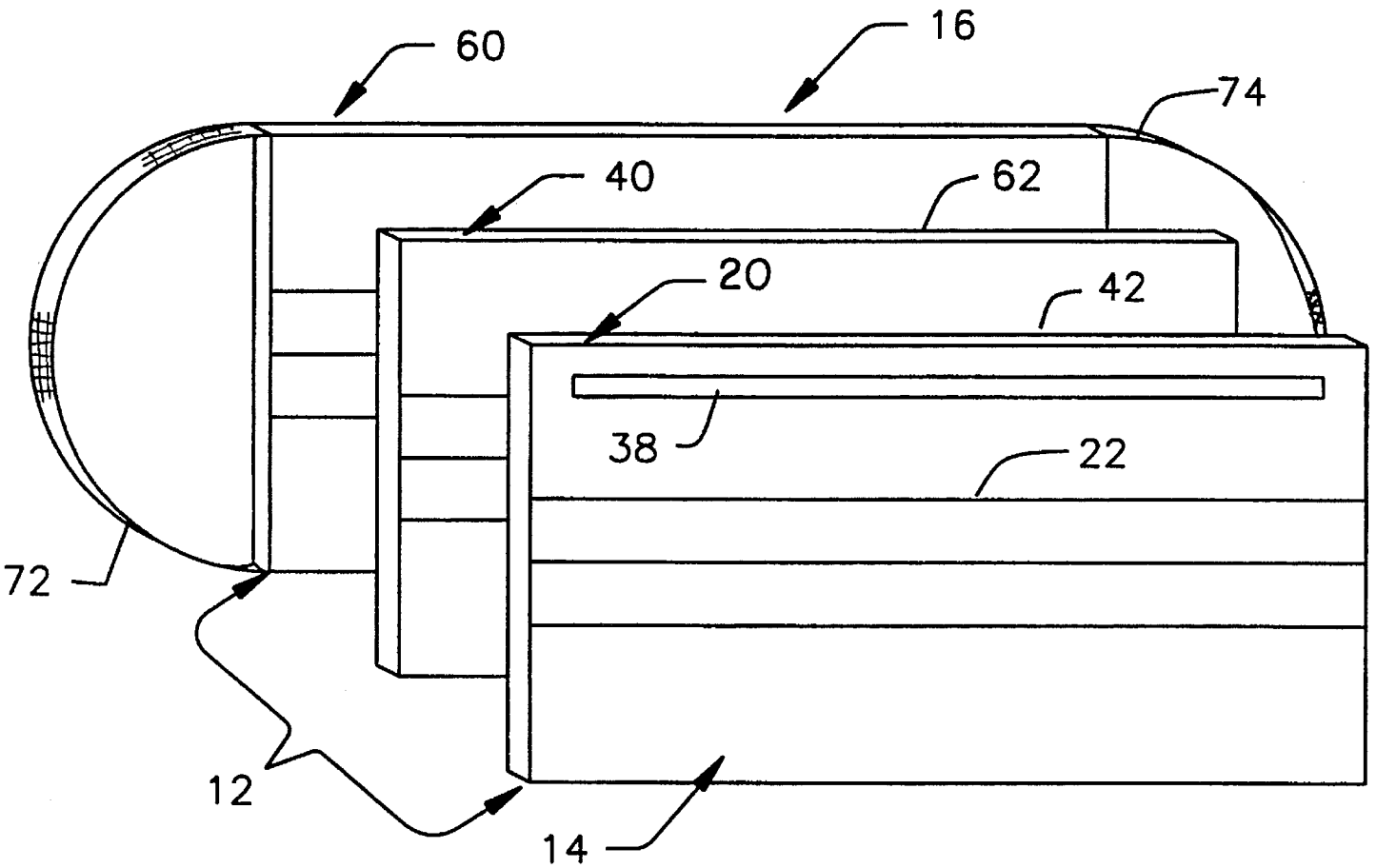
FIG. 3 is a perspective rear view of the first embodiment of the present invention showing the three-ply laminate structure in a breakaway sectional view in which the outermost ply has the ear loops attached.

The disposable, air permeable, liquid-restraint face mask 10 and its component parts of the first embodiment are represented in FIGS. 1 through 5. FIG. 3 shows that face mask 10 is made of a three-ply laminate composite structure 12, where the first layer 20 is the inside or inner section 14 of mask 10 where the user's nose and mouth are covered by the airlaid paper material 22. The second layer 40 is the middle section of the mask 10 and is made of an air permeable filter barrier, meltblown, polypropylene material 42. The third layer 60 is the outside or outer section 16 of the mask 10 and is made of an air permeable, thermobond, polypropylene material 62.

The perimeter edges of the face mask 10 are the top inner perimeter edge 24, the bottom inner perimeter edge 26, and the left and right side inner perimeter edges 28 and 30, respectively, along with the top outer perimeter edge 64, the bottom outer perimeter edge 66, and the left and right side outer perimeter edges 68 and 70, respectively, which are heat sealed by an ultrasonic sealing machine which combine the three-ply of materials 12 into a single composite laminate structure of face mask 10.

Figure 4:
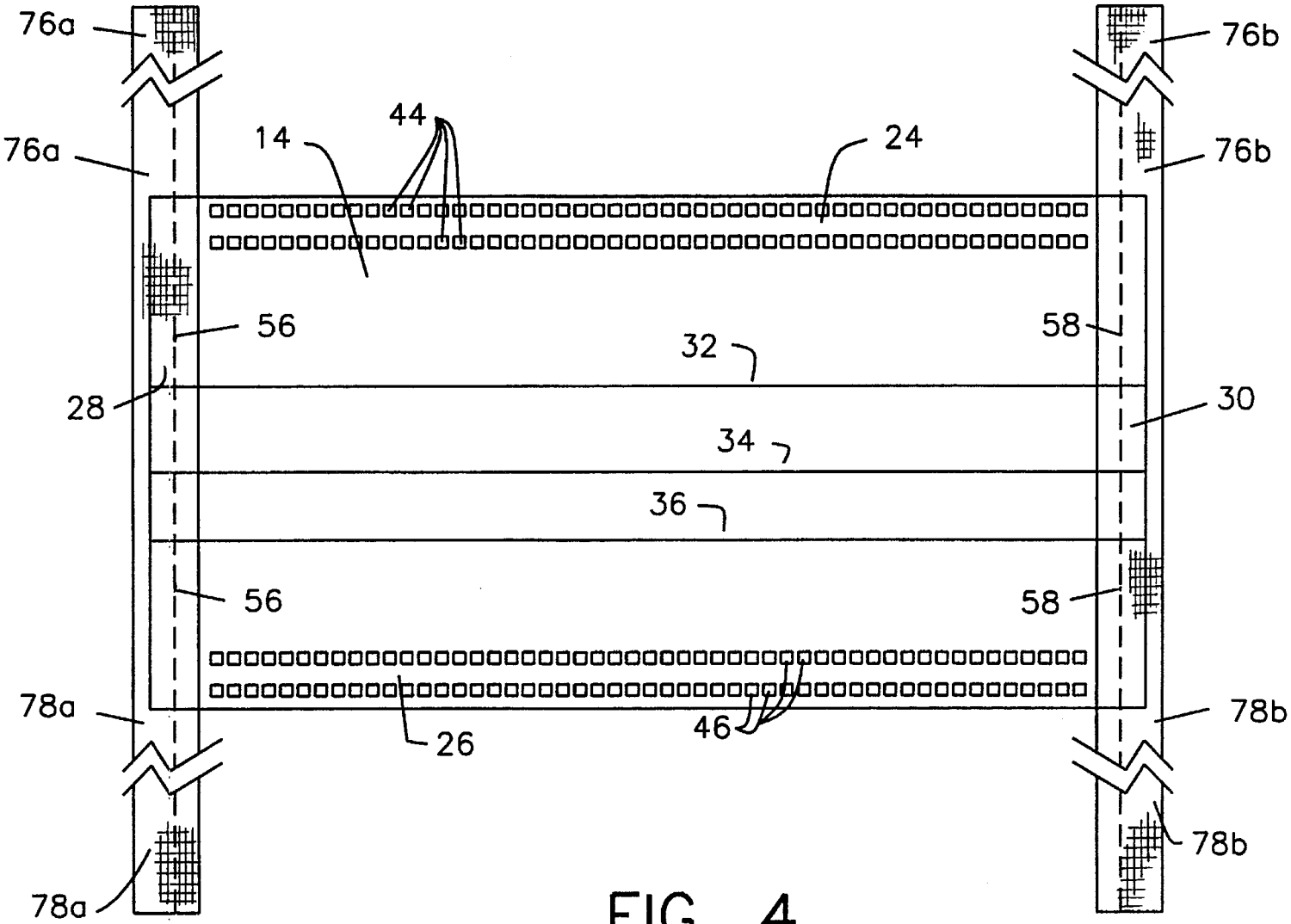
FIG. 4 is a rear view of the first embodiment of the present invention showing the pleated face mask with head ties.
Figure 5:
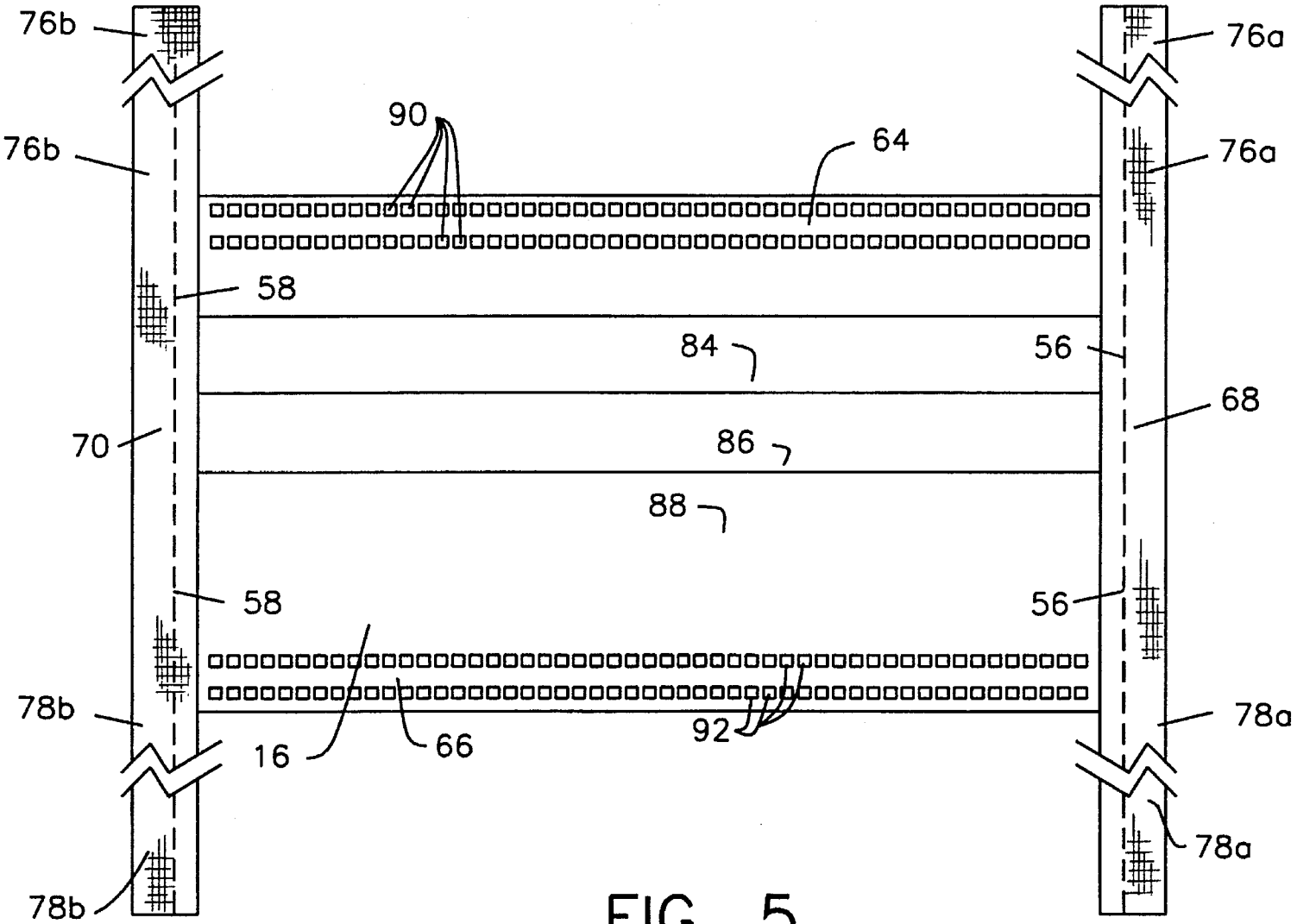
FIG. 5 is a front view of the first embodiment of the present invention showing the pleated face mask with head ties.

The face mask 10 is secured to the wearer by left and right ear loops 72 and 74, respectively, as shown in FIGS. 1, 2, and 3. An alternate fastening means can be used by the wearer, such that upper and lower head ties 76*a*, 76*b*, 78*a*, and 78*b* secure the face mask 10 to the head of the user, as shown in FIGS. 4 and 5.

As shown in FIG. 3, the first layer 20 of face mask 10 is made of a non-woven, airlaid paper material 22. This airlaid paper material 22 comprises non-woven paper pulp material, carded cotton wadding material, and creped tissue wadding material. The airlaid paper 22 is liquid resistant and air permeable. The thickness of the first layer 20 of airlaid paper 22 is approximately 0.43 mm, with the weight of the airlaid paper 22 being 50 g/m$^2$. The airlaid paper 22 has an elongation factor of 13 percent. The airlaid paper 22 can be sterilized by steam, ethylene oxide, and/or gamma rays.

The preferred range of thickness of airlaid paper 22 is 0.40 mm to 0.45 mm, while the weight of airlaid paper 22 is in the range of 45 to 55 g/m$^2$. The elongation factor is in the range of 13 percent to 17 percent.

As shown in FIG. 3, the second layer 40 of face mask 10 is made of a non-woven, meltblown, polypropylene filter media material 42. The filter media 42 acts as a microbial barrier and a liquid-resistant barrier for the wearer of the face mask 10. The thickness of the second layer 40 of the filter media fabric 42 is approximately 0.225 mm and is in the range of 0.15 mm to 0.30 mm, with the weight of the filter media fabric 42 being 25 g/m$^2$. The filter media fabric 42 has an elongation factor of at least 20 percent. The filter media fabric 42 can be sterilized by steam or ethylene oxide.

The weight of the filter media fabric 42 is in the range of 22.5 to 27.5 g/m$^2$, and the elongation factor is in the range of 20 percent to 30 percent.

As shown in FIG. 3, the third layer 60 of face mask 10 is made of a non-woven, thermobond, polypropylene material 62. The thermobond, polypropylene material 62 is liquid resistant and acts as a liquid and particulate barrier/retainer for the wearer of the mask 10. The thickness of the third layer 60 of the thermobond, polypropylene material 62 is approximately 0.15 mm, with the weight of the thermobond PP material 62 being 20 g/m$^2$. The thermobond PP material 62 has an elongation factor of 50 percent. The thermobond PP material 62 can be sterilized by steam, ethylene oxide, and/or gamma rays.

The range of thickness of the thermobond, polypropylene material 62 is 0.13 mm to 0.17 mm, while the weight of the thermobond, polypropylene material 62 is in the range of 18 to 22 g/m$^2$. The elongation factor is in the range of 48 percent to 52 percent.

DETAILED DESCRIPTION OF THE SECOND EMBODIMENT 100

Figure 6:
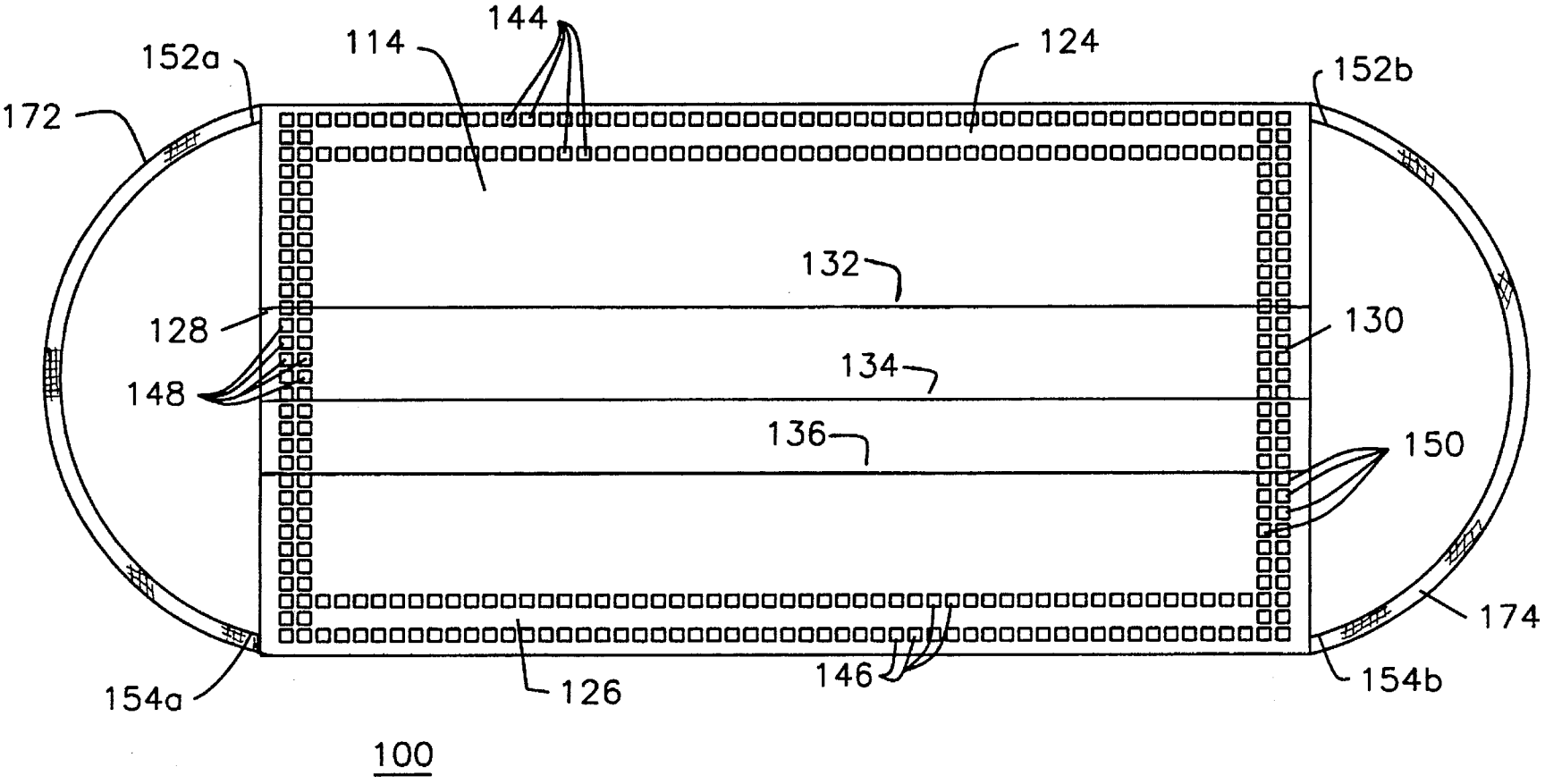
FIG. 6 is a rear view of the second embodiment of the present invention showing the pleated face mask with ear loops.
Figure 7:
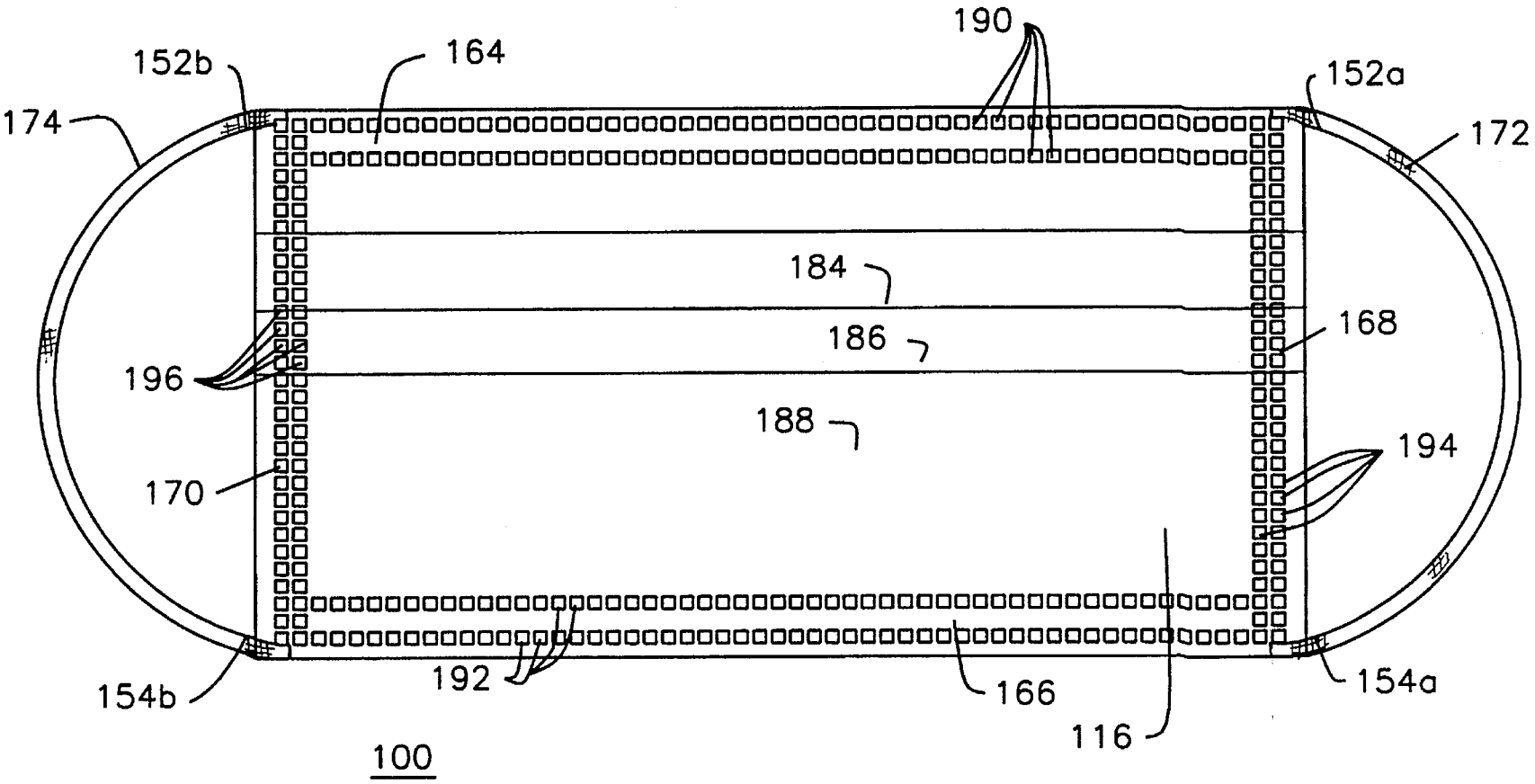
FIG. 7 is a front view of the second embodiment of the present invention showing the pleated face mask with ear loops.
Figure 8:
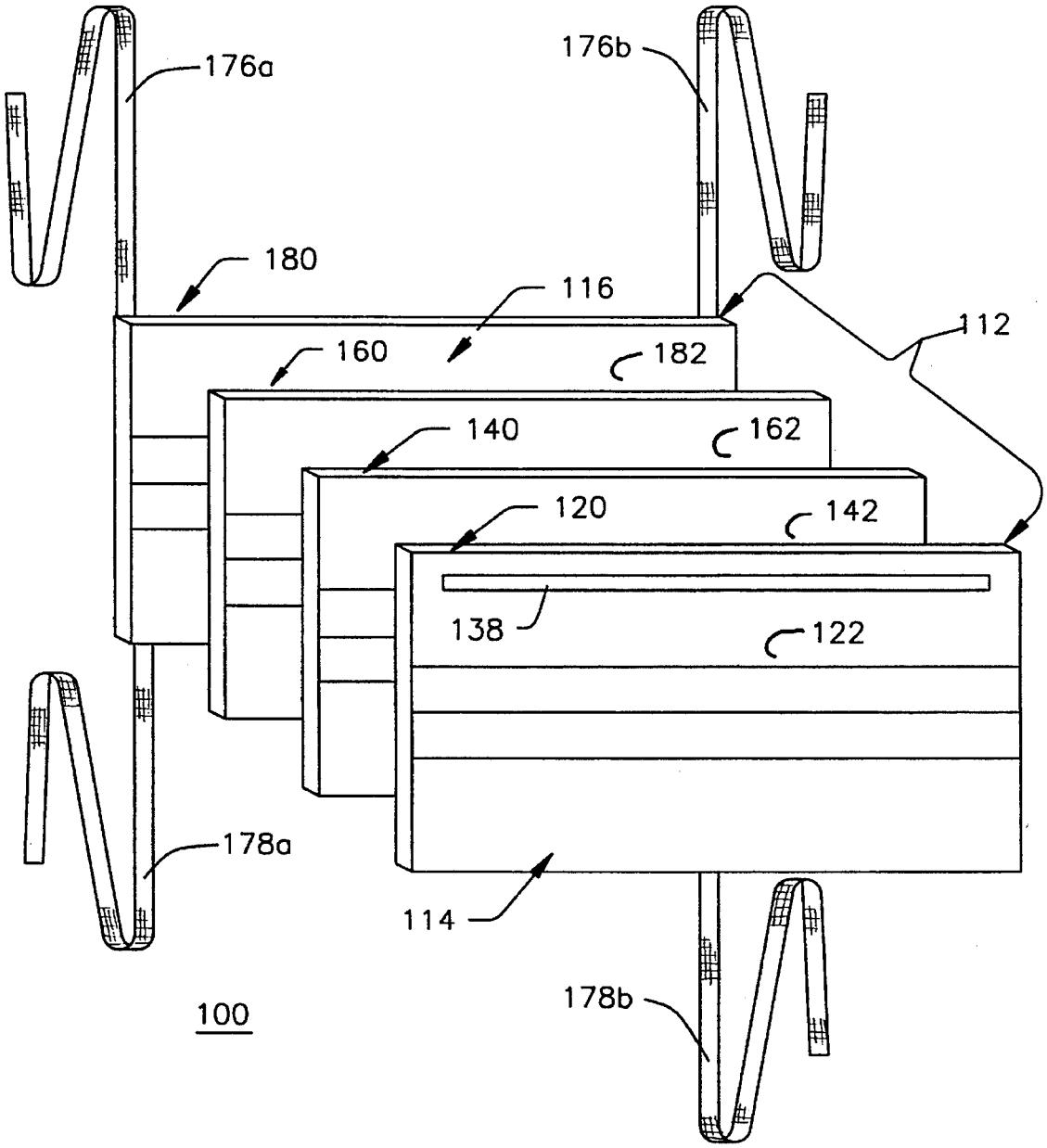
FIG. 8 is a perspective rear view of the second embodiment of the present invention showing the four-ply laminate structure in a breakaway sectional view in which the outermost ply has head ties attached.

The disposable, air permeable, liquid-resistant face mask 10 and its component parts of the second embodiment are represented in FIGS. 6 through 10. FIG. 8 shows that face mask 100 is made of a four-ply laminate composite structure 112, where the first layer 120 is the inside or inner section 114 of the mask 100 where the user's nose and mouth are covered by a soft, air permeable, non-woven, colored spunbond, polypropylene fabric material 122. The second layer 140 is the second section of mask 100 and is made of airlaid material 142. The third layer 160 is the third section of mask 10 and is made of an air permeable filter barrier material comprising meltblown, polypropylene 162. The fourth layer 180 is the outside or outer section 116 of mask 100 and is made of liquid-resistant, barrier material comprising air permeable, thermobond, polypropylene 182.

The perimeter edges of the face mask 100 are the top inner perimeter edge 124, the bottom inner perimeter edge 126, and the left and right side inner perimeter edges 128 and 130, respectively, along with the top outer perimeter edge 164, the bottom outer perimeter edge 166, and the left and right side outer perimeter edges 168 and 170, respectively, which are heat sealed by an ultrasonic sealing machine which combine the four-ply of materials 112 into a single composite laminate structure of face mask 100.

Figure 9:
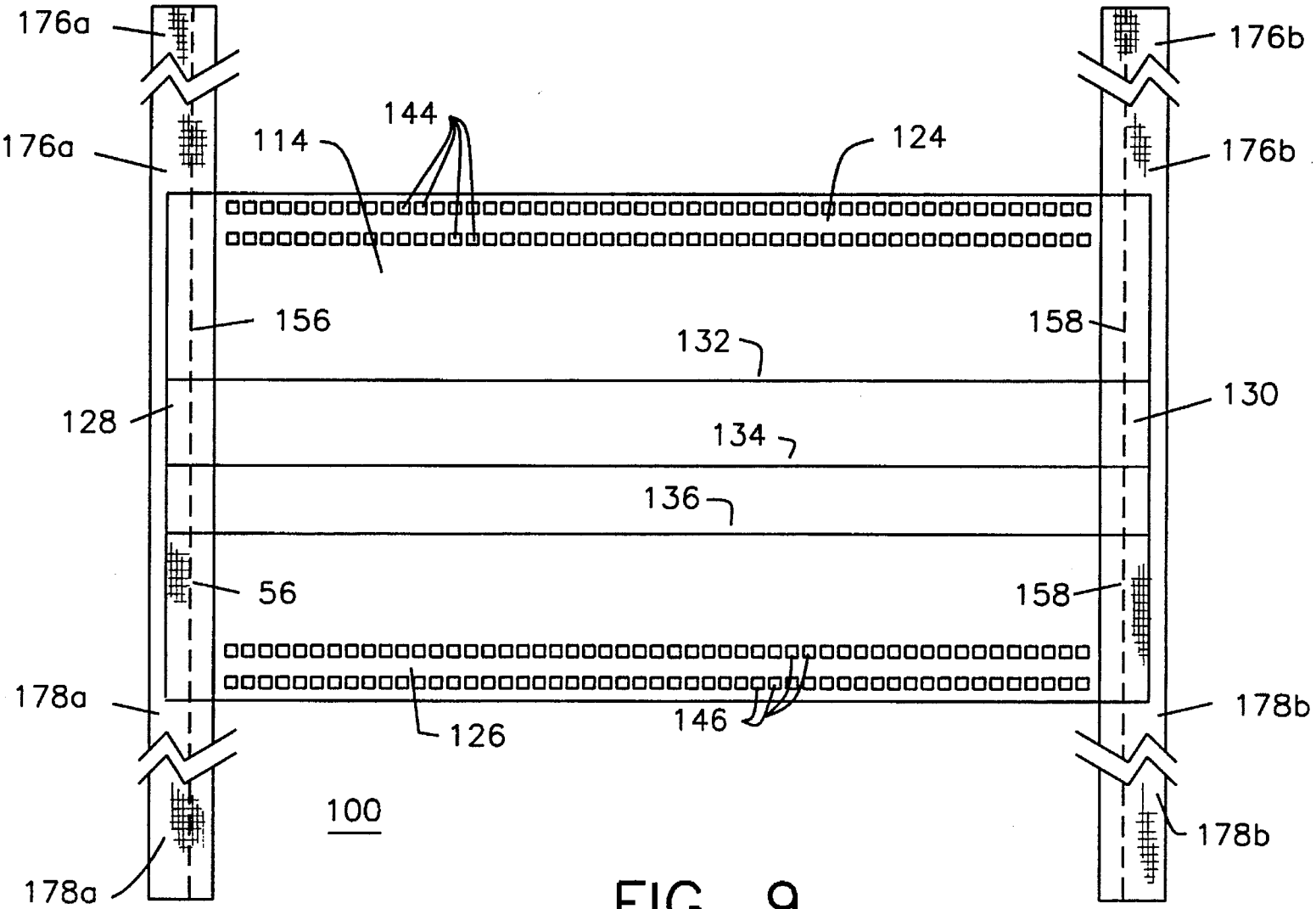
FIG. 9 is a rear view of the second embodiment of the present invention showing the pleated face mask with head ties.
Figure 10:
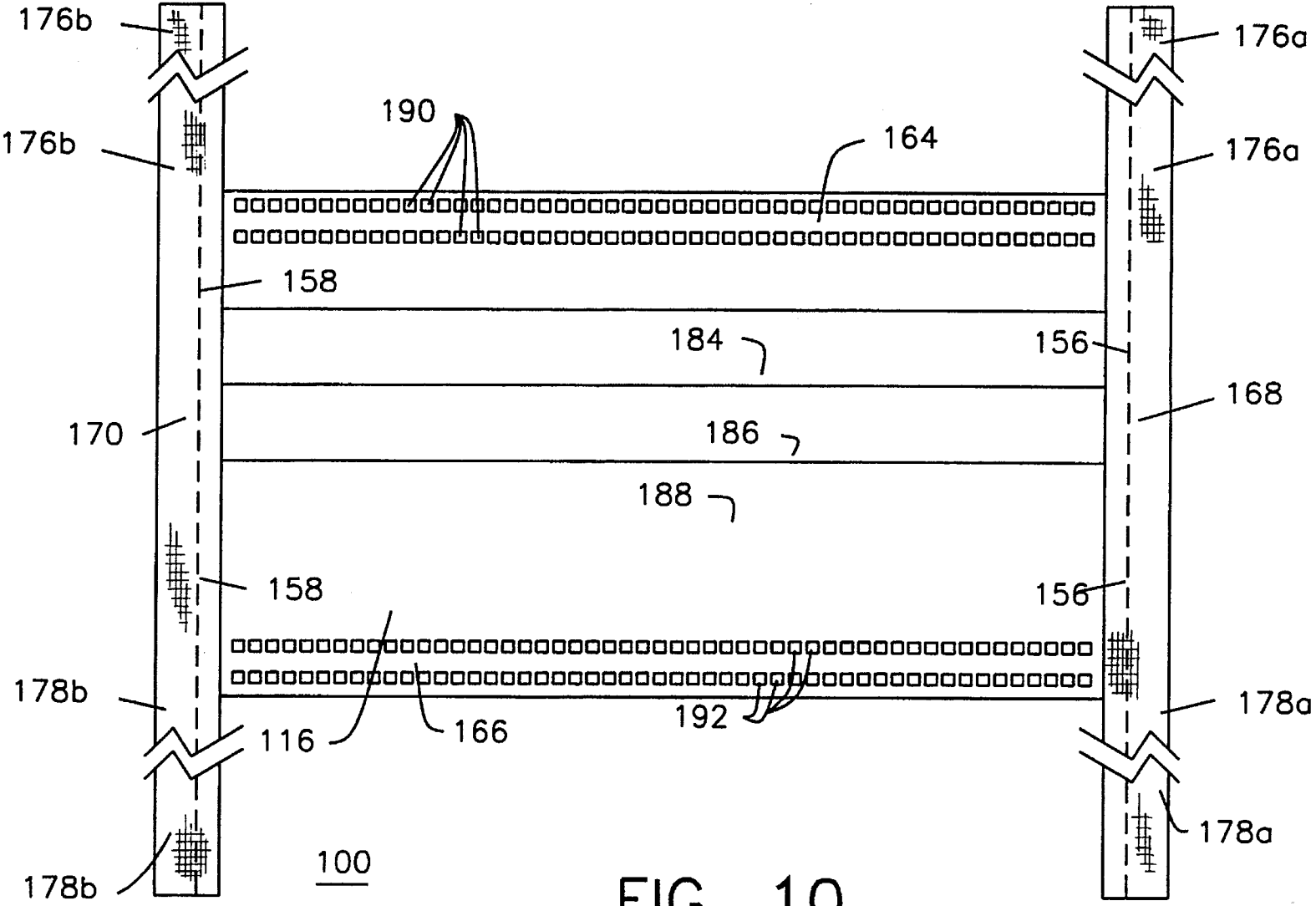
FIG. 10 is a front view of the second embodiment of the present invention showing the pleated face mask with head ties.

The face mask 100 is secured to the wearer by left and right ear loops 172 and 174, respectively, as shown in FIGS. 6 and 7. An alternate fastening means can be used by the wearer, such that upper and lower head ties 176*a*, 176*b*, 178*a*, and 178*b* secure the face mask 100 to the head of the user, as shown in FIGS. 8, 9, and 10.

As shown in FIG. 8, the first layer 120 of face mask 100 is made of non-woven, colored, spunbond, polypropylene material 122. The spunbond, polypropylene material 122 is liquid resistant and acts as a soft contact layer to the face of the wearer and also acts as an initial liquid and particulate barrier/retainer for the wearer of the mask 100. The thickness of the first layer 120 of spunbond, polypropylene material 122 is approximately 0.225 mm, with the weight of the spunbond PP 122 being approximately 35 g/m$^2$. The spunbond PP material 122 has an elongation factor of 50 percent. The spunbond PP material 122 can be sterilized by steam, ethylene oxide, and/or gamma rays, and can be any desired color, such as blue or green.

The range of thickness of the spunbond, polypropylene material 122 is 0.22 mm to 0.25 mm, while the weight of the spunbond, polypropylene material is in the range of 30 to 40 g/m$^2$. The elongation factor is in the range of 48 percent to 52 percent.

As shown in FIG. 8, the second layer 140 of face mask 100 is made of a non-woven, airlaid paper material 142. This airlaid paper material 142 comprises non-woven paper pulp material, carded cotton wadding material, and creped tissue wadding material. The airlaid paper 142 is liquid resistant and air permeable. The thickness of the second layer 140 of airlaid paper 142 is approximately 0.43 mm, with the weight of the airlaid paper 142 being 50 g/m$^2$. The airlaid paper 142 has an elongation factor of 13 percent. The airlaid paper 142 can be sterilized by steam, ethylene oxide, and/or gamma rays.

The preferred range of thickness of airlaid paper 142 is 0.40 mm to 0.45 mm, while the weight of airlaid paper 142 is in the range of 45 to 55 g/m$^2$. The elongation factor is in the range of 13 percent to 17 percent.

As shown in FIG. 8, the third layer 160 of face mask 100 is made of a non-woven, meltblown, polypropylene filter media material 162. This filter media 162 is liquid resistant and acts as a microbial barrier and a liquid-resistant barrier for the wearer of the face mask 100. The thickness of the third layer 160 of the filter media fabric 162 is approximately 0.225 mm and is in the range of 0.15 mm to 0.30 mm, with the weight of the filter media 162 being 25 g/m$^2$. The filter media 162 has an elongation factor of at least 20 percent. The filter media 162 can be sterilized by steam or ethylene oxide.

The weight of the filter media 162 is in the range of 22.5 to 27.5 g/m$^2$, and the elongation factor is in the range of 20 percent to 30 percent.

As shown in FIG. 8, the fourth layer 180 of the face mask 100 is made of a non-woven, thermobond, polypropylene material 182. The thermobond, polypropylene material 182 is liquid resistant and acts as a liquid and particulate barrier/retainer for the wearer of the mask 100. The thickness of the fourth layer 180 of the thermobond, polypropylene material 182 is approximately 0.15 mm, with the weight of the thermobond PP material 182 being 20 g/m$^2$. The thermobond PP material 182 has an elongation factor of 50 percent. The thermobond PP material 182 can be sterilized, by steam, ethylene oxide, and/or gamma rays.

The range of thickness of the thermobond, polypropylene material 182 is 0.13 mm to 0.17 mm, while the weight of the thermobond, polypropylene material 182 is in the range of 18 to 22 g/m$^2$. The elongation factor is in the range of 48 percent to 52 percent.

ASSEMBLY OF THE FACE MASK

In assembling the disposable face mask 10 of the first embodiment, the layers 20, 40, and 60 are superimposed on each other by a fabric-layering apparatus. The layers 20, 40, and 60 are in the form of rolls and are supplied to the layering apparatus where they are placed over each other to form the three-ply structure 12 shown in FIG. 3.

In assembling the disposable face mask 100 of the second embodiment, the layers 120, 140, 160, and 180 are superimposed on each other by a fabric-layering apparatus. The layers 120, 140, 160, and 180 are in the form of rolls and are supplied to the layering apparatus where they are placed over each other to form the four-ply structure 112 shown in FIG. 8.

The following assembly steps apply to both the three-ply or four-ply face mask 10, 100 in the formation of a final face mask product.

The three-ply laminate structure 12 or the four-ply laminate structure 112 is moved to a folding apparatus where the three-ply or four-ply structure 12, 112 is folded to the desired width. The three-ply or four-ply structure 12, 112 is folded three times to form three overlapping sections 32, 34, and 36 or 132, 134, and 136 on the inner face side 14, 114 and folded three times to form three overlapping sections 84, 86, and 88 or 184, 186, 188 on the outer face side 16.

Simultaneously, a pliable and bendable metal/plastic PVC strip 38, 138 is placed along one edge of the top inner perimeter edge 24, 124 and is then folded to cover the metal strip 38, 138. This bendable metal/plastic PVC strip 38, 138 is used for the contouring of the face mask 10, 100 on the nose and cheeks of the wearer.

Occurring also in this step is the folding of the bottom inner perimeter edge 28, 128 of the three-ply or four-ply structure 12, 112 which provides the final desired width of the folded face mask 10, 100.

The folded three-ply or four-ply structure 12, 112 is then heat sealed by an ultrasonic sealing machine in a continuous fashion, such that the top inner and outer perimeter edges 24 and 64 or 124 and 164 along with the bottom inner and outer perimeter edges 26 and 66 or 126 and 166 are sealed simultaneously. As shown in FIGS. 1, 2, 4, 5, 6, 7, 9, and 10, the heat sealing bonds the three-ply or four-ply structure 12, 112 into a top inner and outer sealed perimeter edging 44 and 90 or 144 and 190 along with the bottom inner and outer sealed perimeter edging 46 and 92 or 146 and 192.

The folded three-ply or four-ply structure material 12, 112 is then moved to a fabric-cutting apparatus where the folded structure material 12, 112 is cut to a desired length in a continuous fashion.

The folded structure material 12, 112 is then moved to another folding apparatus where the left and right side inner face 14, 114 perimeter edges 28 and 30 or 128 and 130 are folded to a final desired length.

The final cut and folded length of structure material 12, 112 is then moved to another heating-sealing ultrasonic machine where the left inner and outer perimeter edges 28 and 68 or 128 and 168 along with the right inner and outer perimeter edges 30 and 70 or 130 and 170 are sealed simultaneously in a continuous fashion. A shown in FIGS. 1, 2, 6, and 7, the heat sealing bonds the three-ply or four-ply structure 12, 112 into a left inner and outer sealed perimeter edging 48 and 94 or 148 and 194 along with the right inner and outer sealed perimeter edging 50 and 96 or 150 and 196.

The three-ply or four-ply structure material 12, 112 is now in its final sealed size of desired width and length for face mask 10, 100 where the last step consists of heat sealing the left and right ear loops 72 and 74 or 172 and 174 to the inner face side 14, 114. Each ear loop 72 and 74 or 172 and 174 has an upper and lower tab end 52 and 54 or 152 and 154 for sealing of those tab ends 52 and 54 or 152 and 154 to the top and bottom inner sealed perimeter edgings 44 and 46 or 144 and 146 by the ultrasonic heat-sealing apparatus.

When the alternate fastening means of head ties 76*a*, 76*b*, 78*a*, and 78*b* or 176*a*, 176*b*, 178*a*, and 178*b* are used for face mask 10, 100, their attachment is done by stitching, as shown in FIGS. 4, 5, 9, and 10. This above step eliminates the ultrasonic heat sealing of the left and right side inner and outer perimeter edging 48, 50, 94, and 96 or 148, 150, 194, and 196 by the replacement step of stitching the upper and lower head ties 76*a*, 76*b*, 78*a*, and 78*b* or 176*a*, 176*b*, 178*a*, and 178*b* to the left and right side perimeter edge 56, 58 or 156, 158 of face mask 10, 100.

ADVANTAGES OF THE PRESENT INVENTION

Accordingly, the primary advantage of the present invention is that it provides a disposable, pleated face mask that is liquid resistant.

Another advantage of the present invention is that it provides a disposable, pleated face mask that has a three-ply laminate composite structure, wherein all of the plies are a non-woven, liquid-resistant, non-absorbent fabric material.

Another advantage of the present invention is that it provides a disposable, pleated face mask that has a four-ply laminate composite structure, wherein all of the plies are a non-woven, liquid-resistant, non-absorbent fabric material.

Another advantage of the present invention is that it provides a disposable, pleated face mask that prevents the passage of liquids through the face mask by trapping any liquids within the interstices of the laminate composite structure while still allowing air to pass through the mask to the wearer.

Still another advantage of the present invention is that it provides a disposable, pleated face mask, wherein the laminate plies are formed of a non-woven, airlaid paper material, and non-woven polypropylene materials.

Still a further advantage of the present invention is that it provides an economical and efficient method of manufacturing a liquid-resistant, disposable face mask.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A pleated, disposable, air permeable, liquid-resistant face mask having three plies of material, comprising:

a) a first face-contacting ply of liquid-resistant material formed of a non-woven paper pulp material, a carded cotton wadding material, and a creped tissue wadding material for filtering out organic and inorganic particulate matter;

b) a second ply of liquid-resistant material formed of a non-woven, polypropylene material to form a first filter barrier for filtering out organic and inorganic particulate matter;

c) a third ply of liquid-resistant material formed of a non-woven, polypropylene material to form a second filter barrier for filtering out organic and inorganic particulate matter;

d) said first, second, and third plies being folded relative to each other to form pleated and overlapping sections which expand relative to each other during use;

e) a flexible stiffening member disposed within said mask and being bendable to conform to the shape of the wearer's face;

f) the edges of said first, second, and third plies being attached to form a composite laminate structure; and g) fastening means for fastening said face mask to the wearer's face.

2. A pleated, disposable face mask in accordance with claim 1, wherein said first ply has a material thickness of 0.43 mm, a weight of 50 g/m$^2$, and an elongation factor of 13 percent.

3. A pleated, disposable face mask in accordance with claim 1, wherein said first ply has a material thickness in the range of 0.40 mm to 0.45 mm, a weight in the range of 45 to 55 g/m$^2$, and an elongation factor in the range of 13 percent to 17 percent.

4. A pleated, disposable face mask in accordance with claim 1, wherein said second ply is a meltblown, polypropylene material.

5. A pleated, disposable face mask in accordance with claim 1, wherein said second ply has a material thickness of 0.225 mm, a weight of 25 g/m$^2$, and an elongation factor of at least 20 percent.

6. A pleated, disposable face mask in accordance with claim 1, wherein said second ply has a material thickness in the range of 0.15 mm to 0.30 mm, a weight in the range of 22.5 to 27.5 g/m$^2$, and an elongation factor in the range of 20 percent to 30 percent.

7. A pleated, disposable face mask in accordance with claim 1, wherein said third ply is a thermobond, polypropylene material and is a heat-resistant material.

8. A pleated, disposable face mask in accordance with claim 1, wherein said third ply has a material thickness of 0.15 mm, a weight of 20 g/m$^2$, and an elongation factor of 50 percent.

9. A pleated, disposable face mask in accordance with claim 1, wherein said third ply has a material thickness in the range of 0.13 mm to 0.17 mm, a weight in the range of 18 to 22 g/m$^2$, and an elongation factor in the range of 48 percent to 52 percent.

10. A pleated, disposable face mask in accordance with claim 1, wherein said face mask is heat resistant for sterilization purposes.

11. A pleated, disposable face mask in accordance with claim 1 having three overlapping pleats located in the generally central section of said face mask.

12. A pleated, disposable face mask in accordance with claim 1, wherein said face mask has a length dimension of 17.5 cm, a width dimension of 9 cm, and a general thickness of 1 mm.

13. A pleated, disposable face mask in accordance with claim 1, wherein said flexible stiffening member is made of plastic and metal and is disposed along the upper edge of said face mask.

14. A pleated, disposable face mask in accordance with claim 1, wherein said edges of the composite structure are attached by heat sealing, stitching, stapling, or gluing.

15. A pleated, disposable face mask in accordance with claim 1, wherein said fastening means are elastic ear loops.

16. A pleated, disposable face mask in accordance with claim 15, wherein said elastic ear loops are attached to said composite structure by heat sealing, stitching, stapling, or gluing.

17. A pleated, disposable face mask in accordance with claim 1, wherein said fastening means are a plurality of head ties formed of thermobond polypropylene, nylon, rayon, or cloth.

18. A pleated, disposable face mask in accordance with claim 17, wherein said plurality of head ties are attached to said composite structure by heat sealing, stitching, stapling, or gluing.

19. A pleated, disposable, air permeable, liquid-resistant face mask having four plies of material, comprising:

a) a first ply of liquid-resistant material formed of a non-woven, colored, spunbond, polypropylene material which forms the face-contacting member;

b) a second ply of liquid-resistant material formed of a non-woven paper pulp material, a carded cotton wadding material, and a creped tissue wadding material to form a first filter barrier for filtering out organic and inorganic particulate matter;

c) a third ply of liquid-resistant material formed of a non-woven, polypropylene material to form a second filter barrier for filtering out organic and inorganic particulate matter;

d) a fourth ply of liquid-resistant material formed of a non-woven, polypropylene material to form a third filter barrier for filtering out organic and inorganic particulate matter;

e) said first, second, third, and fourth plies being folded relative to each other to form pleated and overlapping sections which expand relative to each other during use;

f) a flexible stiffening member disposed within said mask and being bendable to conform to the shape of the wearer's face;

g) the edges of said first, second, third, and fourth plies being attached to form a composite laminate structure; and h) fastening means for fastening said face mask to the wearer's face.

20. A pleated, disposable face mask in accordance with claim 20, wherein said first ply has a material thickness of 0.225 mm, a weight of 35 g/m$^2$, and an elongation factor of 50 percent.

21. A pleated, disposable face mask in accordance with claim 19, wherein said first ply has a material thickness in the range of 0.20 mm to 0.25 mm, a weight in the range of 30 to 40 g/m$^2$, and an elongation factor in the range of 48 percent to 52 percent.

22. A pleated, disposable face mask in accordance with claim 19, wherein the non-woven material in said second ply is airlaid paper material.

23. A pleated, disposable face mask in accordance with claim 19, wherein said second ply has a material thickness of 0.43 mm, a weight 50 g/m$^2$, and an elongation factor of 13 percent.

24. A pleated, disposable face mask in accordance with claim 19, wherein said second ply has a material thickness in the range of 0.40 mm to 0.45 mm, a weight in the range of 45 to 55 g/m$^2$, and an elongation factor in the range of 13 percent to 17 percent.

25. A pleated, disposable face mask in accordance with claim 19, wherein said third ply is a meltblown, polypropylene material.

26. A pleated, disposable face mask in accordance with claim 19, wherein said third ply has-a material thickness of 0.225 mm, a weight of 25 g/m$^2$, and an elongation factor of at least 20 percent.

27. A pleated, disposable face mask in accordance with claim 19, wherein said third ply has a material thickness in the range of 0.15 mm to 0.30 mm, a weight in the range of 22.5 to 27.5 g/m$^2$, and an elongation factor in the range of 20 percent to 30 percent.

28. A pleated, disposable face mask in accordance with claim 19, wherein said fourth ply is a thermobond, polypropylene material and is a heat-resistant material.

29. A pleated, disposable face mask in accordance with claim 19, wherein said fourth ply has a material thickness of 0.15 mm, a weight of 20 g/m$^2$, and an elongation factor of 50 percent.

30. A pleated, disposable face mask in accordance with claim 19, wherein said fourth ply has a material thickness in the range of 0.13 mm to 0.17 mm, a weight in the range of 18 to 22 g/m$^2$, and an elongation factor in the range of 48 percent to 52 percent.

31. A pleated, disposable face mask in accordance with claim 19, wherein said face mask is heat resistant for sterilization purposes.

32. A pleated, disposable face mask in accordance with claim 19 having three overlapping pleats located in the generally central section of said face mask.

33. A pleated, disposable face mask in accordance with claim 19, wherein said face mask has a length dimension of 17.5 cm, a width dimension of 9 cm, and a general thickness of 1.20 mm.

34. A pleated, disposable face mask in accordance with claim 19, wherein said flexible stiffening member is made of plastic and metal and is disposed along the upper edge of said face mask.

35. A pleated, disposable face mask in accordance with claim 19, wherein said edges of the composite structure are attached by heat sealing, stitching, stapling, or gluing.

36. A pleated, disposable face mask in accordance with claim 19, wherein said fastening means are elastic ear loops.

37. A pleated, disposable face mask in accordance with claim 36, wherein said elastic ear loops are attached to said composite structure by heat sealing, stitching, stapling, or gluing.

38. A pleated, disposable face mask in accordance with claim 19, wherein said fastening means are a plurality of head ties formed of polypropylene, nylon, rayon, or cloth.

39. A pleated, disposable face mask in accordance with claim 38, wherein said plurality of head ties are attached to said composite structure by heat sealing, stitching, stapling, or gluing.

* * * * *